US006391353B1

(12) United States Patent
Marbler et al.

(10) Patent No.: US 6,391,353 B1
(45) Date of Patent: May 21, 2002

(54) PACKAGING WITH TEAR-OFF CLOSURE

(75) Inventors: Claude A. Marbler, Phalsbourg; Frédéric Froemer, Sarrebourg, both of (FR)

(73) Assignee: Alusuisse Technology and Management Ltd. (CH)

( * ) Notice: Subject to any disclaimer, the term of this patent is extended or adjusted under 35 U.S.C. 154(b) by 0 days.

(21) Appl. No.: 09/552,517

(22) Filed: Apr. 19, 2000

(30) Foreign Application Priority Data

May 6, 1999 (EP) ..... 99810394

(51) Int. Cl.[7] ..... B65D 3/04; B65D 3/26; B65D 17/40

(52) U.S. Cl. ..... 426/115; 426/122; 383/111; 383/904; 383/906

(58) Field of Search ..... 426/115, 85, 86, 426/122, 123; 229/87.05, 87.08, 103.1, 938; 383/111, 904, 906, 209

(56) References Cited

U.S. PATENT DOCUMENTS

| | | | | | |
|---|---|---|---|---|---|
| 1,603,207 | A | * | 10/1926 | Huston | 426/115 |
| 1,641,408 | A | * | 9/1927 | Bainridge et al. | 383/111 |
| 2,371,521 | A | * | 3/1945 | Heywood et al. | |
| 2,549,039 | A | * | 4/1951 | Adams | |
| 2,809,771 | A | * | 10/1957 | Ward | 426/115 |
| 3,154,225 | A | * | 10/1964 | Wadlinger et al. | 426/115 |
| 3,453,661 | A | * | 7/1969 | Repko | 426/115 |
| 4,116,338 | A | | 9/1978 | Weichselbaum | |
| 4,119,128 | A | * | 10/1978 | Bishop | |
| 4,183,424 | A | * | 1/1980 | Watt | 426/115 |
| 4,264,629 | A | * | 4/1981 | Oogliotti | 229/87.08 |
| 4,589,553 | A | * | 5/1986 | Ferrero | 829/938 |
| 4,648,506 | A | * | 3/1987 | Campbell | 426/115 |
| 4,888,188 | A | * | 12/1989 | Castner et al. | 426/117 |
| 4,898,477 | A | * | 2/1990 | Cox et al. | 426/122 |
| 5,482,202 | A | * | 1/1996 | Wen | 229/103.1 |
| 5,564,591 | A | * | 10/1996 | Chiristine et al. | |
| 5,758,473 | A | * | 6/1998 | Patelli | 426/122 |
| 5,873,514 | A | * | 2/1999 | Brooks | 229/103.2 |
| 6,076,664 | A | * | 6/2000 | Yeager | |

FOREIGN PATENT DOCUMENTS

| | | | | |
|---|---|---|---|---|
| FR | 2653749 | * | 5/1991 | 426/117 |
| GB | 2 121 757 | | 1/1984 | |
| WO | WO 96/32342 | | 10/1996 | |
| WO | WO 98/35886 | | 9/1998 | |

* cited by examiner

*Primary Examiner*—Steven Weinstein
(74) *Attorney, Agent, or Firm*—Fisher, Christen & Sabol

(57) ABSTRACT

Packaging (10) featuring a tear-off closure with an tearing aid for freeing an opening (34) to remove the contents (32) is such that, at least in the region of the opening, layers of packaging material forming an outer (20) and inner part (22) of the packaging are superimposed, separated or separable from each other. The aid to tearing is arranged on the outer part (20) of the packaging in such a manner that the outer part of the packaging is separated from the inner part of the packaging a distance (a) from the opening and the inner part of the packaging is exposed in the region of the opening. The inner part (22) of the packaging which is revealed on tearing open the packaging is free of germs with the result that the packaging is suitable for consuming drinkable and/or edible contents by mouth directly from the packaging.

9 Claims, 1 Drawing Sheet

PACKAGING WITH TEAR-OFF CLOSURE

BACKGROUND OF THE INVENTION

1. Field of the Invention

The invention relates to packaging featuring a tear-off closure with a tearing aid for freeing an opening to remove the contents, such that on tearing open the packaging the region of the opening is suitable for introducing the contents into the mouth for direct consumption of the contents.

2. Background of the Invention

Known forms of flexible packaging for bars of chocolate, biscuits, dairy products and the like sweet foodstuffs include a tube-like envelope in the form of a closed envelope of film material which is closed at both ends by an adhesive or sealing seam. To remove the contents the envelope is torn open at one end, the tearing operation normally being assisted by provision of an aid to tearing in the form of a notch or a line of weakness. The opening created this way in the tube-shaped packaging enables the contents—sliding on the inner side of the envelope—to be pushed out of the packaging by pressing on the closed end. This kind of packaging is particularly suitable for direct consumption of the contents whereby the opening region is introduced to or into the mouth after tearing open the packaging. In such a case it is hardly possible e.g. after making contact with the surface of the packaging to prevent bacteria and similar pathogenic agents on the surface from entering the mouth. The danger should not be underestimated especially in the case of children who are the main consumers of sweet foodstuffs packaged in such a manner.

BROAD DESCRIPTION OF THE INVENTION

The object of the present invention is to provide packaging of the kind described at the start, which after opening, may be introduced to or into the mouth without danger of contamination with germs.

The object of the invention is achieved in that, at least in the region of the opening, the packaging exhibits superimposed, separated or separable layers of packaging material forming an outer and inner part of the packaging, and the aid to tearing is arranged on the outer part of the packaging in such a manner that the outer part of the packaging is separated from the inner part a distance from the opening and in the region of the opening the inner part of the packaging is exposed.

On tearing open the packaging according to the invention the contaminated outer part is thereby removed, revealing the uncontaminated inner part of the packaging. The "aseptic mouthpiece" created in this manner may therefore be introduced to or into the mouth to remove the contents without danger of infection.

A first version is such that the inner part of the packaging may be a pipe-shaped or tubular-shaped insert part outside the opening region and joined to the outer part of the packaging. The insert part may, however, also extend over the whole length of the packaging and in this case need not compulsorily be attached to the outer part of the packaging.

A preferred second version of the packaging according to the invention comprises a foil laminate made up of a film facing the interior of the packaging and an outer film facing outside the packaging, whereby in the region of the region of the opening the inner and outer films are not bonded together, or if so then with smaller force than over the rest of the packaging. Thereby, it may be useful to provide a second tearing aid on the inner film for the purpose of creating the opening.

The aids to tearing the packaging open comprise in particular notches, in particular line-shaped partial cuts or perforations and the like lines of weakness.

A preferred field of application for the packaging according to the invention is in the packaging of drinkable and/or edible contents which are suitable for direct consumption i.e. direct transfer from the packaging to the mouth. Examples of such forms of packaging are, apart from the tube-shaped-envelopes mentioned at the start, also pouches for liquids or drinks and for paste-type contents. In the case of the last mentioned forms of packaging the opening region is pipe-shaped or tubular shaped.

BRIEF DESCRIPTION OF THE DRAWING

Further advantages, features and details of the invention are revealed in the following description of preferred exemplified embodiments and with the aid of the drawing which shows in the following.

DETAILED DESCRIPTION OF THE INVENTION

Figure 1:
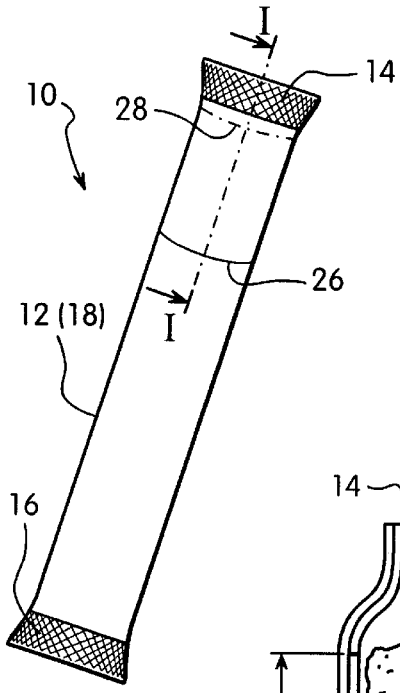
FIG. 1 is a front elevation of a tube-shaped form of packaging.

A form of packaging 10 shown in FIG. 1 e.g. for chocolate bars features a tube-shaped envelope 12 made of a film-type of material. Both ends of the envelope are closed by sealing seams 14, 16.

Figure 3:
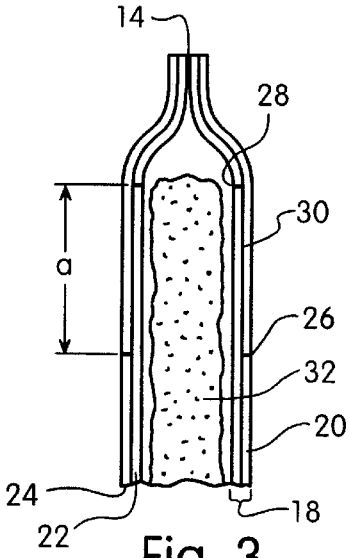
FIG. 3 is a cross-section through the opening region of the packaging in FIG. 1, along line I—I.
Figure 5:
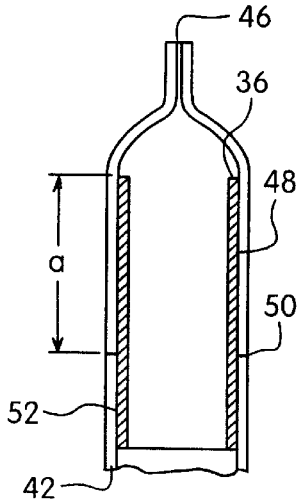
FIG. 5 is a cross-section through the opening region of the pouch shown in FIG. 4, along line II—II.

As shown in FIG. 3 the envelope 12 comprises a film-type laminate 18 made up of an inner film 22 facing the interior of the packaging and a film 20 facing out from the packaging. Both films 20, 22 are joined via a permanent adhesive 24 to make up the laminate 18, whereby in the region of the opening in the packaging 10 there is a zone 30 which is free of adhesive. This adhesive-free zone 30 is delimited by a line of weakness 26 in the outer film 20 as aid to tearing and by a second line of weakness 28 in the inner film 22 as a second aid to tearing. Thereby, the second line of weakness 28 in the inner film 22 lies close to the end of the packaging closed off by sealing seam 14 and the first line of weakness 26 in the outer film 20 lies a distance (a) from the second line of weakness 28.

In order to open the packaging 10, the end closed off by the seam 14 is gripped and torn away from the rest of the packaging. In that process the outer film 20 is separated at the first line of weakness 26 and the inner film 22 separated at the second line of weakness 28.

Figure 2:
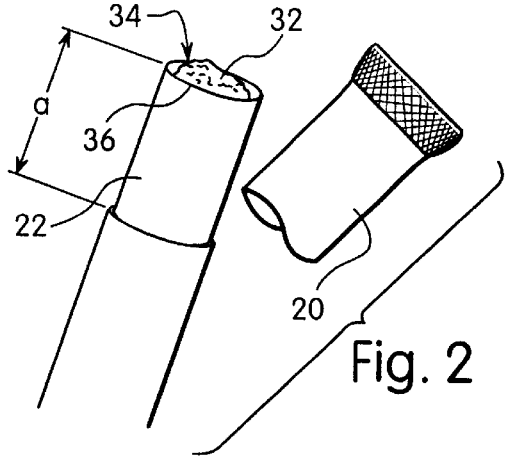
FIG. 2 is a front elevation of a part of the packaging in FIG. 1 shown in the opened state.

FIG. 2 shows the opened packaging 10 which in the region of opening comprises the adhesive-free zone 30 of the inner film 22. The second line of weakness 28 corresponds to the outer edge 36 of the resultant opening 34. The resulting mouthpiece of length "a" of inner film 22 is germ-free and can therefore be taken directly into the mouth to consume the contents, e.g. a bar of chocolate, without any anxiety regarding risk to health.

Figure 4:
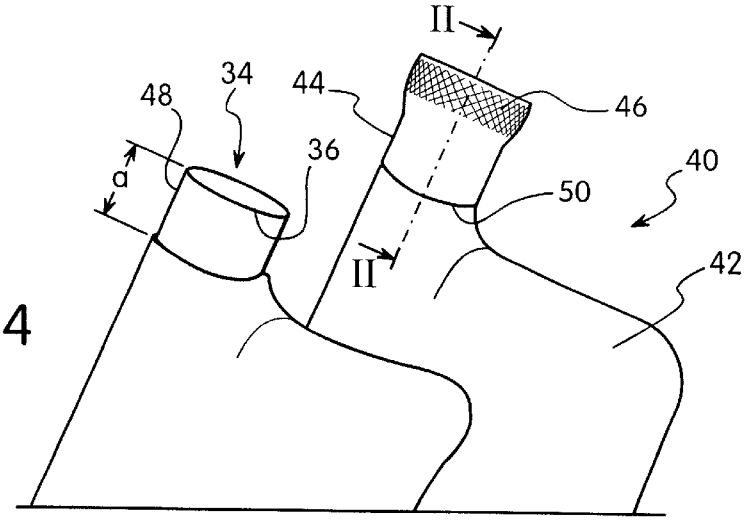
FIG. 4 is a front elevation of a pouch-type of packaging.

A pouch-type of packaging e.g. for drinks shown in FIG. 4 is made up of a film or film type laminate 42 which is tubular-shaped in the region 44 of the opening. The region 44 of the opening is closed off by a seam 46 in the same manner as the open end of the tubular envelope in FIG. 1. In contrast to the version shown in FIG. 1 there is no adhesive-free zone for separating the two foils of the laminate 42. Instead of the inner film 22 of the packaging 10 in FIG. 1 a pipe-shaped or tubular-shaped insert 48 is provided in the tubular-shaped envelope in the region 44 of the opening. Thereby, the end of the of the insert 48 facing the end of the tubular-shaped opening region 44 forms the later opening 34 in the pouch 40. At its other end the insert part 48 is adhesively bonded outside of the opening region to the film 42 via a layer of adhesive 52. A distance (a) from the edge 36 of the opening 34 in the insert part 48 the film 42 features a line of weakness 50 as an aid to tearing.

To open the pouch 40, the film 42 is gripped in the region of the seam 46 and tom off there. In that process the film 42 is separated at the line of weakness 50 with the result that after tearing the foil 42 in the region of the opening, the insert part 48 remains over a length a on the packaging as a germ-free "mouthpiece".

Suitable laminates for manufacturing the forms of packaging according to the invention are e.g. laminates 18 with the inner film 22 e.g. of polyethylene, polypropylene, their copolymers or ionomers and the outer film 20 which may itself be a laminate with an outer film e.g. of oriented polyethylene-terephthalate (PET) or oriented polypropylene (oPP) and an inner film e.g. of oriented polyamide or aluminium. Alternatively, the inner film may be metallised or be provided with a ceramic layer such as $SiO_2$. The permanent adhesive 24 between the outer film 20 and the inner film 22 may e.g. be a polyurethane-based adhesive. Instead of a coating of permanent adhesive the joining of the outer film 20 to the inner film 22 may be achieved by an extrusion coating.

The film-type laminates suitable for manufacturing the packaging according to the invention are not limited to the above mentioned examples and are selected according to the requirements made of the packaging e.g. sealing properties, mechanical protection and stability, barrier action towards oxygen and water vapor, printing properties, thermal stability etc.

What is claimed is:

1. Packaging comprising a tube-shaped envelope having a first end and a second end, both of said ends being closed, the envelope containing foodstuff, said envelope having a longitudinal, central axis extending between the first end and the second end, the envelope consisting of an inner film and an outer film, the outer film is provided with a first line of weakness, tear aid located in the portion of the outer film towards the first end of the envelope, the first tear aid extending around the periphery of the outer film and being positioned generally lateral to the longitudinal, central axis of the envelope, the inner film is provided with a second line of weakness, tear aid that is located between the first end of the envelope and the first tear aid of the outer film, the second tear aid extending around the periphery of the inner film and being positioned generally lateral to the longitudinal central axis of the envelope, the inner film and the outer film are permanently bonded together in the part of the envelope between the first tear aid of the outer film and the second end of the envelope, and wherein between the first and second tear aid, the inner and outer film are either not bonded together, or bonded together with a smaller force than over the permanently bonded rest of the packaging such that upon pulling the first end of the envelope, the inner film and the outer film are each simultaneously separated into two parts by tearing which occurs at the first tear aid and the second tear aid, respectively, thereby causing the first end of the envelope consisting of both portion of the inner film and a larger portion of the outer film to be removed from the envelope such that the first end of the envelope is open to access the foodstuff in the interior of the envelope and such that the portion of the inner film between said first and second tear aid is now exposed and forms an uncontaminated mouthpiece suitable for introducing the contents of the envelope directly into a mouth for direct consumption.

2. The packaging as claimed in claim 1, wherein the first tear aid is a first line of perforations in the outer film.

3. The packaging as claimed in claim 2, wherein a plane formed by the first line of perforations is perpendicular to the longitudinal axis of the envelope.

4. The packaging as claimed in claim 1, wherein the second tear aid is a second line of perforations in the inner film.

5. The packaging as claimed in claim 4, wherein the first tear aid is a first line of perforations in the outer film.

6. The packaging as claimed in claim 4, wherein a plane formed by the second line of perforations is perpendicular to the longitudinal axis of the envelope.

7. The packaging as claimed in claim 1, wherein the lateral periphery of the envelope is circular shaped.

8. The packaging as claimed in claim 1, wherein the first tear aid and the second tear aid are each selected from the group consisting of notches, linear partial cuts or perforations.

9. The packaging as claimed in claim 8, wherein the line of weakness is linear partial cuts or a line of perforations.

* * * * *